US010347236B1

(12) United States Patent
Bastyr et al.

(10) Patent No.: US 10,347,236 B1
(45) Date of Patent: Jul. 9, 2019

(54) METHOD AND APPARATUS FOR CONTINUOUSLY OPTIMIZED ROAD NOISE CANCELLATION

(71) Applicant: Harman International Industries, Incorporated, Stamford, CT (US)

(72) Inventors: Kevin J Bastyr, Franklin, MI (US); Dylan M Stafford, Walled Lake, MI (US); Tingli Cai, Ann Arbor, MI (US); Aditya Kumar, Northville, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/907,625

(22) Filed: Feb. 28, 2018

(51) Int. Cl.
*G10K 11/178* (2006.01)

(52) U.S. Cl.
CPC .. *G10K 11/17823* (2018.01); *G10K 11/17854* (2018.01); *G10K 2210/12821* (2013.01); *G10K 2210/3028* (2013.01); *G10K 2210/3044* (2013.01)

(58) Field of Classification Search
CPC ..... B60G 17/015; B60Q 5/008; B60W 30/06; B60W 30/18145; B60W 30/20; G10K 11/178; G10K 11/1782; G10K 11/17823; G10K 11/1788; G10K 11/17861
USPC ..... 340/445, 538.12; 381/71.4, 301, 71.1, 381/81, 86; 701/23; 702/33, 50; 152/209.3; 280/5.5; 455/569.2; 704/226, 227
See application file for complete search history.

(56) References Cited

U.S. PATENT DOCUMENTS

| | | | | |
|---|---|---|---|---|
| 7,634,095 | B2 * | 12/2009 | Arun | H04M 1/6075 381/109 |
| 8,208,654 | B2 * | 6/2012 | Coutinho | H04H 20/61 381/81 |
| 9,827,989 | B1 * | 11/2017 | Saxman | B60W 30/20 |
| 9,919,704 | B1 * | 3/2018 | Kundu | B60W 30/06 |
| 10,065,561 | B1 * | 9/2018 | Bastyr | B60Q 5/008 |
| 2004/0118494 | A1 * | 6/2004 | Liederer | B60C 11/0318 152/209.3 |
| 2006/0100868 | A1 * | 5/2006 | Hetherington | G10L 21/0208 704/226 |
| 2008/0188271 | A1 * | 8/2008 | Miyauchi | G10L 21/0208 455/569.2 |
| 2009/0058633 | A1 * | 3/2009 | Luo | G10K 11/178 340/538.12 |
| 2009/0060217 | A1 * | 3/2009 | Sakamoto | G10K 11/178 381/71.4 |

(Continued)

*Primary Examiner* — Gerald Gauthier
(74) *Attorney, Agent, or Firm* — Angela M. Brunetti

(57) ABSTRACT

A system and method for applying a set of road noise cancellation parameters to a road noise cancellation system in a vehicle traveling from a first road surface type to a second road surface type, the set being associated with a vehicle type, a tire type, a road surface type, or a vehicle location. The system and method collects and compares data with the set of road noise cancellation parameters in a database to identify when the vehicle has traveled from a first road surface type to a second road surface type and, upon identifying the vehicle has traveled from a first road surface type to a second road surface type, applies the adjusted set of road noise cancellation parameters in the database that optimize the road noise cancellation system for the second road surface type.

20 Claims, 5 Drawing Sheets

(56) References Cited

U.S. PATENT DOCUMENTS

2010/0329488 A1* 12/2010 Holub ..... H04R 27/00 381/301
2011/0142248 A1* 6/2011 Sakamoto ..... G10K 11/178 381/71.4
2012/0112899 A1* 5/2012 Hannon ..... B60C 23/0416 340/445
2012/0230504 A1* 9/2012 Kuroda ..... G10K 11/17837 381/71.4
2013/0315409 A1* 11/2013 Inoue ..... G10K 11/17833 381/71.1
2014/0303905 A1* 10/2014 Jo ..... G01H 1/00 702/33
2014/0348338 A1* 11/2014 Iwamoto ..... F16F 7/1011 381/71.4
2015/0028549 A1* 1/2015 Slater ..... B60G 7/006 280/5.5
2015/0353088 A1* 12/2015 Ishikawa ..... G05D 1/0061 701/23
2016/0019904 A1* 1/2016 Charette ..... G10L 25/60 704/227
2016/0131547 A1* 5/2016 Yanase ..... B60C 23/061 702/50
2017/0076712 A1* 3/2017 Christoph ..... G10K 11/178
2017/0129298 A1* 5/2017 Lu ..... B60G 17/015
2017/0133001 A1* 5/2017 Kim ..... G01S 19/13
2017/0200443 A1* 7/2017 Kurosawa ..... G10K 11/178
2017/0267248 A1* 9/2017 Harda ..... B60W 30/12
2017/0323631 A1* 11/2017 Close ..... G10K 11/17883
2017/0330551 A1* 11/2017 Zafeiropoulos ..... G10K 11/178
2017/0372690 A1* 12/2017 Valeri ..... G01H 3/14
2018/0047383 A1* 2/2018 Hera ..... G10K 11/178
2018/0308468 A1* 10/2018 Christoph ..... G01H 1/12

* cited by examiner

200

| 202 Road type | 204 Acceleration Signal Characteristics | 206 Microphone Signal Characteristics |
|---|---|---|
| 208 Smooth road | Stationary accelerometer signal with low levels (<0.2g), broadband frequency range (30-400Hz) | Stationary mic levels with low sound levels (<40dBA), correlated to accelerometer signals |
| 210 Cobbled road | Stationary accelerometer signal with high levels (>1g), broadband frequency range (30-400Hz) | Stationary mic levels with low sound levels (>55dBA), correlated to accelerometer signals |
| 212 Rough road (Pebblestone) | Stationary accelerometer signal with medium levels (0.3-0.9g), broadband frequency range (30-400Hz) | Stationary mic levels with low sound levels (~50dBA), correlated to accelerometer signals |
| 214 Grooved concrete | Stationary accelerometer signal with high levels (0.3-0.9g), tonal frequency content (~150Hz) | Stationary mic levels with higher tonal sound levels (<50dBA), correlated to accelerometer signals |
| 216 Cracked road | Non-stationary, impulsive, accel signal with high levels (>1g), broadband (30-400Hz) in nature | Impulse noise input with mid level broadband frequency content (30-400Hz), correlated to accelerometer signals |

FIG. 2

METHOD AND APPARATUS FOR CONTINUOUSLY OPTIMIZED ROAD NOISE CANCELLATION

TECHNICAL FIELD

The inventive subject matter is directed to road noise cancellation and more particularly to a road noise cancellation system having a road type identification.

BACKGROUND

Active Noise Control (ANC) systems attenuate undesired noise using feedforward and feedback structures, to adaptively remove undesired noise within a listening environment, such as within a vehicle cabin. In a vehicle cabin listening environment, potential sources of undesired noise come from the interaction between the vehicle's tires and a road surface on which the vehicle is traveling. A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted road noise. This unwanted road noise inside the cabin is then cancelled, or reduced in level, by using speakers to generate sound waves that are ideally opposite in phase and identical in magnitude to the noise to be reduced at one or more listeners ears. RNC systems are adaptive Least Mean Square (LMS) systems that continuously adapt W filters based on both acceleration inputs from the sensors located in various positions around a vehicle's suspension system and on signals of microphones located in various positions inside the vehicle's cabin.

When a vehicle is under operation, for example driving along a first road surface (i.e., paved), and the road surface changes to a second surface (i.e., gravel), the RNC system must adapt. It may take several minutes to achieve optimal road noise cancellation because the system starts adapting from its previous state, which had been continuously optimized for the first road surface. During the time it takes for the RNC system to converge to a new optimal state, the output of the road noise cancellation system may be sub-optimal which may diminish a user's experience within the vehicle cabin listening environment. During the initial adaptation time, the level of in-cabin noise at locations of the listeners' ears will be higher than if the system were fully adapted.

There is a need for a Road Noise Cancellation system that utilizes road type identification from a set of predetermined tuning parameters to apply W-filters and other road type optimized parameters that produce optimal RNC for the particular road type identified.

SUMMARY

A system and method for road noise cancellation on a vehicle having a road noise cancellation system having a set of road noise cancellation parameters for the road noise cancellation system, each set is associated with a vehicle type, a tire type, a road surface type, or a vehicle location. A database correlates data collected from one or more vehicles with the set of road noise cancellation parameters that optimize road noise cancellation system performance. As data is collected from one or more vehicles it is compared with the set of road noise cancellation parameters in the database and a road noise cancellation system performance threshold value. Upon identifying the vehicle has traveled from a first road surface type to a second road surface type, as determined from the data being collected and compared, the set of road noise cancellation parameters is adjusted to optimize the road noise cancellation.

A computer-readable medium comprising a program, which, when executed by one or more processors performs operations for applying a set of road noise cancellation parameters for a road noise cancellation system in a vehicle traveling on a first road surface type, the set being associated with a vehicle type, a tire type, a road surface type, or a vehicle location. The program collects and compares data with the set of road noise cancellation parameters in a database to identify when the vehicle has traveled from a first road surface type to a second road surface type, and upon identifying the vehicle has traveled from a first road surface type to a second road surface type, applying the set of road noise cancellation parameters in the database that optimize the road noise cancellation system for the second road surface type.

DESCRIPTION OF DRAWINGS

FIG. 2 is a table of road types;

Elements and steps in the figures are illustrated for simplicity and clarity and have not necessarily been rendered according to any particular sequence. For example, steps that may be performed concurrently or in different order are illustrated in the figures to help to improve understanding of embodiments of the inventive subject matter.

DETAILED DESCRIPTION

While various aspects of the inventive subject matter are described with reference to a particular illustrative embodiment, the inventive subject matter is not limited to such embodiments, and additional modifications, applications, and embodiments may be implemented without departing from the inventive subject matter. In the figures, like reference numbers will be used to illustrate the same components. Those skilled in the art will recognize that the various components set forth herein may be altered without varying from the scope of the inventive subject matter.

Any one or more of the servers, receivers, or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof. Any one or more the devices herein may rely on firmware, which may require updates from time to time to ensure compatibility with operating systems, improvements and additional functionality, security updates or the like. Connecting and networking servers, receivers or devices may include, but are not limited to, SATA, Wi-Fi, lightning, Ethernet, UFS, 5G, etc. One or more servers, receivers, or devices may operate using a dedicated operating system, multiple software programs and/or platforms for interfaces such as graphics, audio, wireless networking, enabling applications, integrating hardware of vehicle components, systems, and external devices such as smart phones, tablets, and other systems to name just a few.

Figure 1:
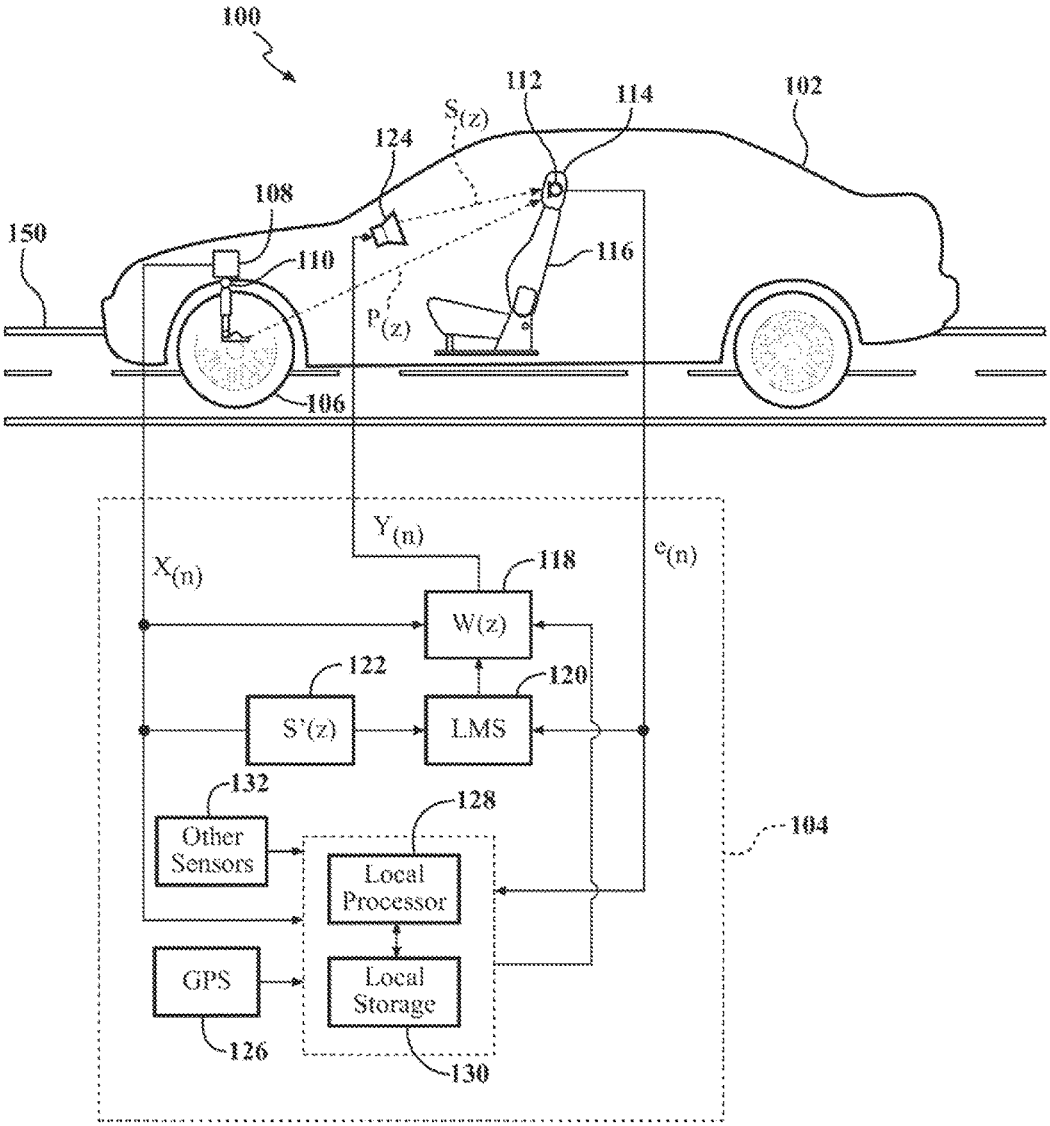
FIG. 1 is a block diagram of an exemplary RNC system.

FIG. 1 shows a block diagram 100 of a vehicle 102 having a road noise cancellation (RNC) system 104 in which one or more vibration sensors 108 are disposed throughout the vehicle 102 to monitor the vibratory behavior of the vehicle's suspension 110, other axle components and chassis. The RNC system 104 is a broadband feed-forward and feedback active noise control framework that generates anti-noise by adaptive filtering of the signals from the vibration sensors 108 combined with microphones 112 and playing the anti-noise signal through one or more speakers 124. Vibration sensors 108 may include, but are not limited to, accelerometers, force gauges, geophones, linear variable differential transformers, strain gauges, and load cells. Single-axis and multi-axis accelerometers 108 may be used to detect the magnitude and phase of acceleration and may also be used to sense orientation, motion, and vibration. A Global Positioning System (GPS) 126 may be onboard the vehicle 102 and may also be used to detect location as well as magnitude and phase of acceleration, orientation, and motion of the vehicle 102.

Noise and vibrations that originate from a wheel 106 moving on a road surface 150 may be sensed by one or more vibration sensors 108 mechanically coupled to a suspension device 110 or a chassis component of the vehicle 102. The vibration sensor 108 outputs a vibration signal x(n) that represents the detected road-induced vibration. It should be noted that multiple vibration sensors are possible and their signals may be used separately, or may be combined together in various ways known by those skilled in the art. The vibration signal x(n) is filtered with a modeled transfer characteristic S'(z) by a filter 122. Road noise that originates from interaction of the wheel 106 and the road surface 150 is also transferred, mechanically and/or acoustically into the passenger cabin and is received by one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102.

The road noise originating from the interaction of the road surface 150 and the wheel 106 is transferred to the microphone 112 according to a transfer characteristic P(z). An error signal e(n) representing the noise present in the cabin of the vehicle 102, is detected by the microphone 112. In the RNC system 104, a filter W(z) 118 is controlled by an adaptive controller 120 which may operate according to a known least mean square (LMS) algorithm based on the error signal e(n) and the vibration signal x(n) filtered with the modeled transfer characteristic S'(z) 122. A signal y(n) is generated by an adaptive filter formed by filter 118 and filter controller 120 based on the vibration signal, or a combination of vibration signals, x(n). Signal y(n) ideally has a waveform such that when played through speaker 124 anti-noise is generated near the occupants' ears and microphone 112 that is ideally opposite in phase and identical in magnitude to that of the road noise audible to the occupants of the vehicle cabin. S(z) represents a transfer function between a loudspeaker 124 and the microphone 112. The anti-noise from speaker 124 combines with road noise in the vehicle cabin near microphone 112 resulting in a reduction of road noise within the cabin.

In addition to the vibration sensors 108 and microphones 112, vehicle 102 also has an array of other sensors 132 on the vehicle 102, which outputs and data are available to a processor 128 onboard the vehicle 102 as well as location-identifying data, such as sensor data from the Global Positioning System (GPS) 126. While the vehicle 102 is under operation, the onboard processor 128, (or an external cloud-based processor which will be discussed later herein with reference to FIGS. 3 and 4), collects and optionally processes the data from sensors 108, 112, 132 and/or GPS data 126 to construct a database or GPS map containing data and/or parameters to be used by the vehicle 102 or other vehicles of the same or different type that travel on the same portion of the road surface 150 in the future (to be discussed later herein with reference to FIG. 4).

Examples of the types of data related to the RNC system 104 that may be useful to store locally at storage 130 onboard the vehicle 102, or in the cloud, for future use by this vehicle or other vehicles include, but are not limited to, optimal W filters, microphone gains, accelerometer gains, frequency dependent leakage and step size, accelerometer or microphone spectra or time dependent signals, other acceleration characteristics including spectral and time dependent properties, and microphone-based acoustic performance data. Note that while this information is being gathered and stored by processor 128, normal operation of the RNC system 104 continues and the W-filter 118 is continuously updated by the LMS 120 system. In addition, onboard processor 128 (or external processor, in vehicle or cloud-based to be discussed later herein) may analyze the aforementioned accelerometer and microphone data and extract key features to determine a set of key road noise cancellation parameters to be applied to the RNC system. The set of key road noise cancellation parameters may be selected when triggered by an event such as identifying a vehicle location and/or sensing a road surface type. A type of road surface may include a road type, such as the road types outlined in FIG. 2. A road surface type may also include particular pavement conditions such as damaged (cracks, pot holes, etc.), newly paved, a paved or unpaved road surface that may degrade over time, an unexpected or temporary condition of the road surface that may be caused by weather, a material spill such as gravel or oil, to name just a few examples.

The road noise cancellation parameters may be stored locally or in the cloud. In general, an updated set of road noise cancellation parameters may be inserted into the RNC algorithm at any point, but is especially effective when the vehicle transitions between different types of road surface. The vehicle RNC system 104 creates an individual database of sensor data, and/or road types, and/or vehicle locations with associated RNC system tuning parameters, performance related data, and/or W-filters, using a processor or computer that may be onboard the vehicle, by analyzing acceleration and microphone characteristics and applying threshold values to detect, or identify, a road type based on sensor output data. The database may also correlate an identified road type with associated optimal tuning parameters and/or W-filters. The data is collected, analyzed and stored and used by the local processor 128 to create a database that is accessed in order to tune the RNC system 104 to more optimal road noise cancellation.

Referring now to FIG. 2 a table 200 is shown that outlines examples of one or more road types 202 defined by signal characteristics, such as acceleration signal characteristics 204 associated with the road type 202 and microphone signal characteristics 206 associated with the road type 202. For a smooth 208 road type, the accelerometer signal may be stationary with low levels, i.e., in the range of less than 0.2 g, and a broadband frequency content of approximately 30-400 Hz. For a cobblestone 210 road type, the accelerometer signal characteristics may be stationary with high levels of acceleration, i.e., in the range greater than 1 g, in the broadband frequency range of 30-400 Hz with especially high levels at the lowest frequencies in this range. For a rough 212 road type, the accelerometer signal may be stationary with a medium acceleration level (0.3-0.9 g) in the frequency range of 30-400 Hz. For a grooved concrete 214 road type, the accelerometer signal may exhibit medium levels (0.3-0.9 g) and high tonal frequency content at approximately 150 Hz. For a cracked 216 road type, the accelerometer signal is non-stationary, impulsive and has high levels (>1 g) over the broadband frequency range from 30-400 Hz. It should be noted that while both typical accelerometer signal characteristics and microphone characteristics are shown in the table 200 of FIG. 2, both sensor types are not necessary to determine road type. Road noise sensed by the microphones in the passenger cabin comes mainly from input acceleration from the road surface which is directly sensed by the accelerometers.

Once a road type has been identified, many key parameters of the LMS RNC system may be optimized to provide the best RNC performance. In known systems, many key RNC system parameters are typically static and are tuned by trained engineers. In these known systems, the key RNC parameters are a tradeoff between parameters that would produce ideal performance on each of a wide range of road types encountered by a vehicle. In these known systems, averaged coefficients are used, resulting in noise cancellation performance that may not be optimal for any one particular road type.

The database described herein may contain key RNC algorithm related sensor outputs and data, which when predetermined threshold values for the outputs and data are met, a type of road upon which the vehicle is being driven may be identified. This allows predetermined values for optimal tuning parameters and W-filters to be referenced and immediately applied to the RNC system LMS algorithm. The database may be stored at the vehicle on a local storage device 130 and includes a map, optimal adaption related parameters including frequency dependent step size and leakage, filters, performance related data, and sensor gains to be used by the RNC system for a faster adaptation from a previous state eliminating performance gaps previously experienced due to system re-adaptation when encountering a new road type.

The database described herein may contain key RNC parameters that are pre-programmed for known segments of road at known locations. In this regard, knowing a vehicle location, such as by a GPS, may trigger an update to the key RNC parameters applied to the RNC system.

Figure 3:
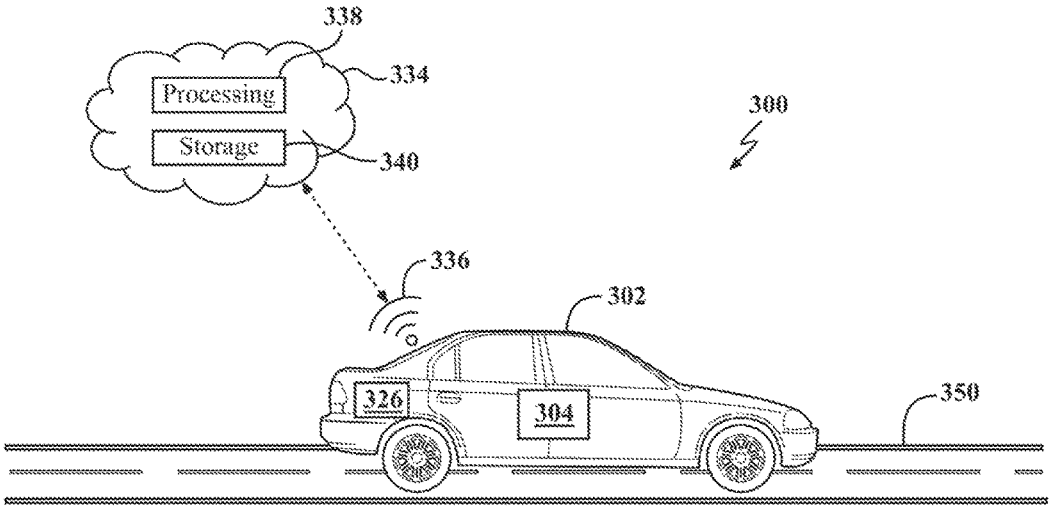
FIG. 3 is a system diagram including cloud-based communication.
Figure 4:
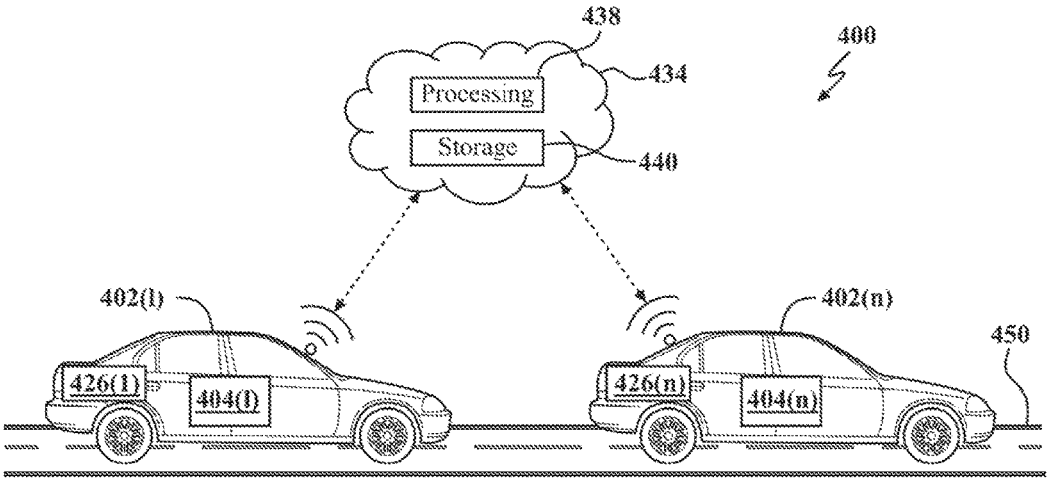
FIG. 4 is s system diagram including cloud-based communication involving a plurality of vehicles.

As discussed with reference to FIG. 1, the on-board processor 128 analyzes the accelerometer and microphone data to be stored locally. However, it is possible that the processing and data storage may occur in the cloud as shown in FIG. 3 and/or may include data provided by multiple vehicles as shown in FIG. 4. In one or more embodiments, the processing and/or storage may be split between the cloud and the local processor.

FIG. 3 shows a system 300 having a vehicle 302 with the capability to connect to the cloud 334 through connecting and networking servers, receivers or devices 336 which may include, but are not limited to, SATA, Wi-Fi, lightning, Ethernet, UFS, Edge, 3G, 4G, 5G. etc. on the vehicle. An RNC system 304, connects to the cloud 334 through the device 336. Cloud processing 338 may then be implemented to analyze sensor data captured by the RNC system 304 and create the database to select optimal tuning parameters. Alternately, or additionally, GPS 326 containing map related data may also be used to select optimal tuning parameters based on a location. The location related data may also include a road type identifier or label that is representative of the road surface 350 that the vehicle is traveling upon. This data may be considered key RNC parameters and may be useful to select optimal tuning parameters and/or update optimal tuning parameters in the database.

Post processing, in the cloud or locally, may identify an earlier, exact transition location where a road type changed more accurately than a real-time system. Eliminating hysteresis in practical real-time implementation would avoid false road type changes. Future vehicles crossing the exact transition location may instantly download or utilize ideal parameters without waiting for LMS convergence or execution of the road type identification process.

The data collected and/or processed 338 within the cloud 334 may be specific to sensor data sent to the cloud 334 from the vehicle's RNC system 304 or it may be compiled within the cloud 334 using data sent from the vehicle and/or data from other sources (not shown in FIG. 3) to be accessed by or downloaded to the vehicle 302 and its RNC system 304. In this regard, other sources may include, but are not limited to, other vehicles (to be described in detail later herein with reference to FIG. 4), GPS data, known navigation data, Google street view image analysis of road type, and other sources too numerous to list comprehensively. For example, a particular vehicle make and model has RNC performance that may be similar to other vehicles of the same make and model. The vehicle 302 may obtain an RNC parameter database customized for the particular make and model that resides within the cloud. The database will be accessed by the vehicle 302 RNC system 304. Storage 340 in the cloud may alleviate storage concerns that may be associated with local storage on the vehicle. Two-way communication between the vehicle 302 and the cloud 334 also allows data from the database or map to be uploaded to the cloud for use, or download, by other vehicles.

FIG. 4 is a system diagram 400 of a cloud-based system that uses data uploaded by multiple vehicles, 402(1) . . . 402(*n*) to create the database. All or portions of the database may then be shared, as by download, among vehicles with access to the cloud. In the system shown in FIG. 4, a plurality of vehicles 402(1)-402(*n*) with connection to the cloud-based processing and storage may send sensor data and RNC 404 system data from their vehicles and locations, as from GPS 426(1)-426(*n*), that is to be used in the development of the database. Because multiple vehicles are supplying data, the database may be continuously updated and improved using data and feedback provided by the plurality of vehicles. Using a connection to the cloud, any one or more vehicles may receive any updated database to ensure that a most current, and most successful in terms of performance, version of the database is used by the RNC system 404(1)-(*n*) on the vehicles 402(1)-(*n*).

The data provided by the plurality of vehicles 402(1)-(*n*) may be location-based GPS data that references the type of road with a vehicle's location. The data may also be accessed as vehicle make/model based data or tire type data that references the RNC settings that have been previously adapted and applied by RNC systems for the location, the type of road surface that is known or has previously been identified based on a success, or failure, or previous versions of the tuning parameters for the particular location, the type of vehicle, the tire type data or any combination thereof.

Cloud-based processing and data storage is advantageous in that machine learning or other analytics from multiple sources, such as multiple vehicles travelling at a particular location, provide data that is valuable to the RNC system on all vehicles either by make and model type, tire type, and/or by vehicle location and a road type identified at the vehicle location. The cloud-based processing and data storage may be beneficial as it takes into consideration that some data may be of less use to some vehicles due to the fact that it may contain traits that are unique to a particular vehicle, such as the state of tire tread. Further, application of an adaptive algorithm that provides continuous updates to the database may take into account changes in road conditions that may be affected by factors such as weather conditions, traffic conditions or a general condition of the road as it degrades, is repaired, or is resurfaced over time. The adaptive algorithm may be applied to on-board processing, cloud-based processing, and multi-vehicle cloud-based processing. Collecting, analyzing and storing the data collected, the optimized parameter adjustments, and the RNC system responses to the applied adjustments allows the database to be continually updated and improved.

Updates to the database may be developed and downloaded in the event the RNC system 104, 304, 404(1)-(*n*) detects inferior RNC performance. Such RNC performance may be estimated by simply analyzing active noise control error microphone signals, or the signals of any microphone mounted inside the vehicle cabin, preferably near the ears of any passengers. For each type of vehicle and for each road type, a target sound pressure level (SPL) may be programmed. If a detected SPL exceeds the target SPL, the RNC system parameters may be adapted or downloaded. A direct measurement of the performance of the RNC system may be made by measuring an in-cabin SPL while the RNC system is active and again while the RNC system is deactivated and making a differential comparison. If the difference between the two measurements is less than a band averaged, or frequency by frequency target, then the parameters may be adapted or downloaded.

Alternatively, the performance of the RNC system may be estimated by analyzing an error signal from the microphones entering the LMS system optionally subtracting out the music signal and/or other extraneous signals such as voice (to be discussed later herein with reference to FIG. 6). These signals, combined with the accelerometer signals, W filters and estimated secondary paths (modeled transfer characteristic S'(z)) may provide an estimate of an amount of road noise cancellation at the microphones, which signal is an estimate of the RNC system performance. If the estimate signal does not meet a predetermined threshold value, the RNC 104, 304, 404(1)-(*n*) system may adapt or download new parameters. Again, collecting, analyzing and storing the data collected, the optimized parameter adjustments, and the RNC system responses to the applied adjustments allows the database to be continually updated and improved based on actual RNC system performance.

Figure 5:
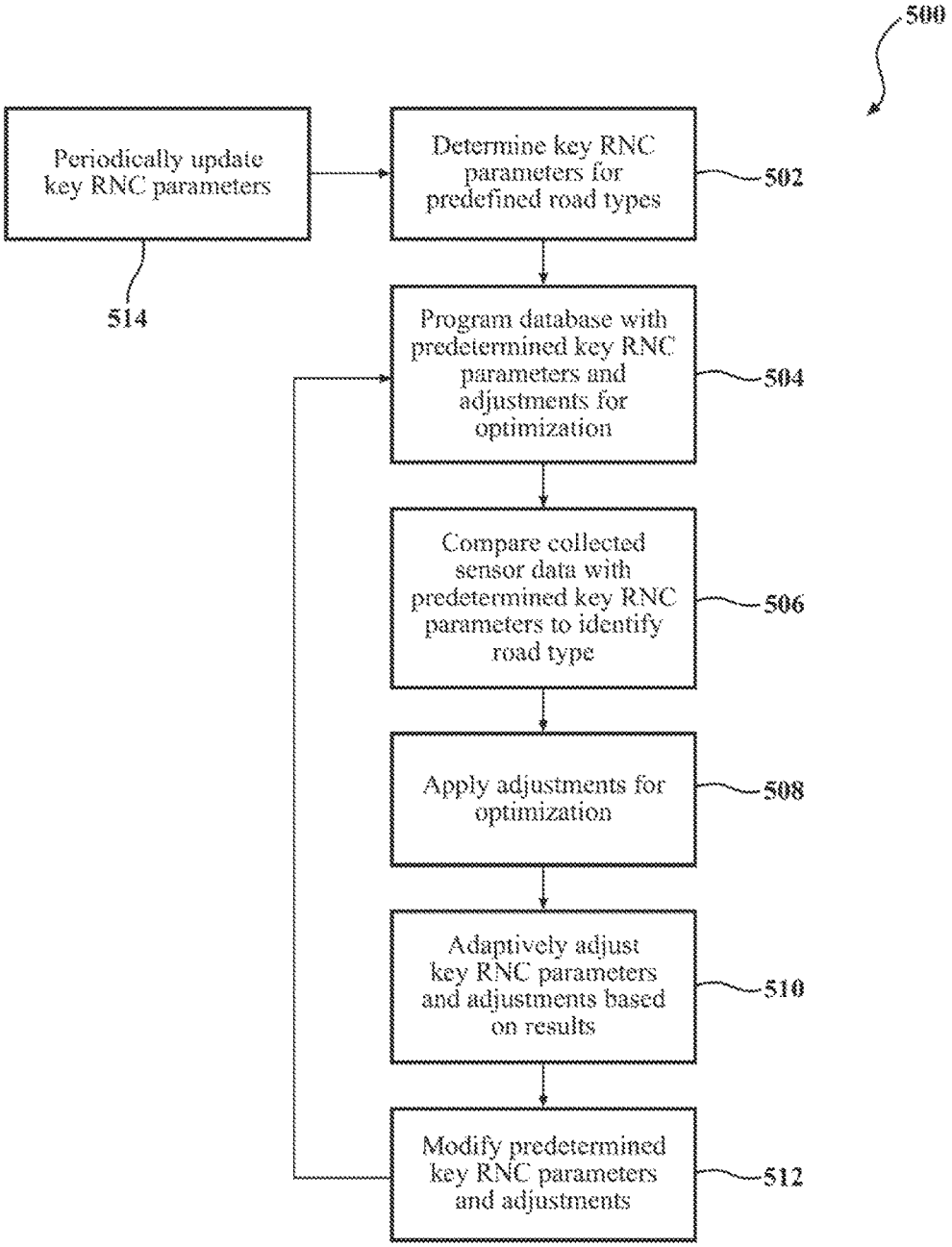
FIG. 5 is a flow chart of one or more methods.

Referring to FIG. 5, a flowchart 500 describes one approach to developing and accessing the database. Key RNC system parameters to optimize RNC performance for each road type the vehicle may travel on are predetermined 502 as a starting point. This may be accomplished through data collected from actual road trials and/or in a laboratory setting. The RNC parameters that detect, or identify, the type of road and the settings associated with optimized performance are programmed 504 into the database. As discussed above with reference to FIGS. 1, 3 and 4, the key RNC parameters and optimized settings may be stored locally in an on-board processor, in the cloud, or locally in the RNC system. When the vehicle encounters a particular road type, the sensor signals may be analyzed and optionally processed to help the RNC system detect, or identify, the road type 506. Accessing the database provides information about adjustments to the key parameters that are applied 508 to optimize the RNC system for the road type identified through sensor data.

Alternatively and/or additionally, an adaptive algorithm may extract and adaptively adjust 510 operating results from key RNC parameters from the RNC system and further optimize key algorithm parameters 512, optionally beginning with the predetermined and pre-programmed RNC parameters database. For example, when instability is repeatedly detected in the adaption of W-filter, frequency dependent leakage may be increased, or if this adaptation is detected to be slow, due to the RNC effect being slow to improve and the microphone error signal taking a long time to decrease step size may be appropriately increased. Step size is a tradeoff between convergence speed and stability, so such an adaptive algorithm will take this into consideration and optimize parameters accordingly.

In another approach, key RNC parameters may be periodically updated 514 in the cloud (or locally) for download based on road tests and/or results of laboratory simulations that may be conducted to ensure key RNC parameters are being provided, even for vehicles that do not have regular access to the advantages of cloud-based processing or an adaptive algorithm approach.

In another example, the adaptive algorithm monitors the spectrum of the signals from the accelerometers into the LMS block. If the spectrum is not flat with frequency to a predetermined tolerance, the algorithm may adaptively adjust filters to flatten the response. The result is convergence becoming identically fast at all frequencies while improving stability at frequencies having the lowest amplitude. Specifically, if extreme low frequency noise is detected on the accelerometer signal, the adaptive algorithm adapts filters (Infinite Impulse Response filters, IIRx and IIRe), see FIG. 6, accordingly to flatten the response prior to the LMS algorithm optimizing W(z). It is also possible to adapt a smooth road turn-on/turn-off threshold upon detection that the RNC algorithm is boosting, instead of reducing, the road noise in the passenger cabin. For example, if the accelerometer sensor noise floor is audible.

Once a road type has been optionally identified, many key parameters of the LMS RNC system may be optimized to provide the best RNC performance. Referring to FIG. 6, a block diagram 600 shows many of the key RNC system parameters that may be used to optimize RNC system performance for each identified road type. FIG. 6 shows a single accelerometer 608, speaker 624 and microphone 612 for simplicity purposes only. It should be noted that typical RNC systems use many accelerometers (10 or more for example), many speakers (4 to 8 for example) and multiple microphones (4 to 6 for example). Other key parameters include, but are not limited to, one or more high pass filters HPFa 652, HPFb 654 to reduce the lowest frequency components of signals from the accelerometers 608 and microphones 612, a first filter IIRx 656 and a second filter IIRe 658. The filters 656 and 658 typically have similar magnitude and phase characteristics to achieve optimal performance of the LMS algorithm. The filters are applied to emphasize or de-emphasize certain frequency ranges. For example, when the filters are set to have a peak filter of 10 dB centered at 200 Hz, the adaptation of that LMS system 620 will reduce more noise in this frequency range. It should be noted that an overall lower amount of noise cancellation will occur over the entire bandwidth of the LMS system is acting, though more noise cancellation will occur in the frequency range or ranges of interest.

It should also be noted that the filters 656 and 658 are shown as IIR for example purposes only and that other filter topologies, such as Finite Impulse Response (FIR) filters, may also be used. An addition of music 660 on the speakers 624 reproducing anti-noise is also shown. The music playback signal 658 may be removed from the error signal of microphone 612 after being passed through a copy of S'(z) 622.

Figure 6:
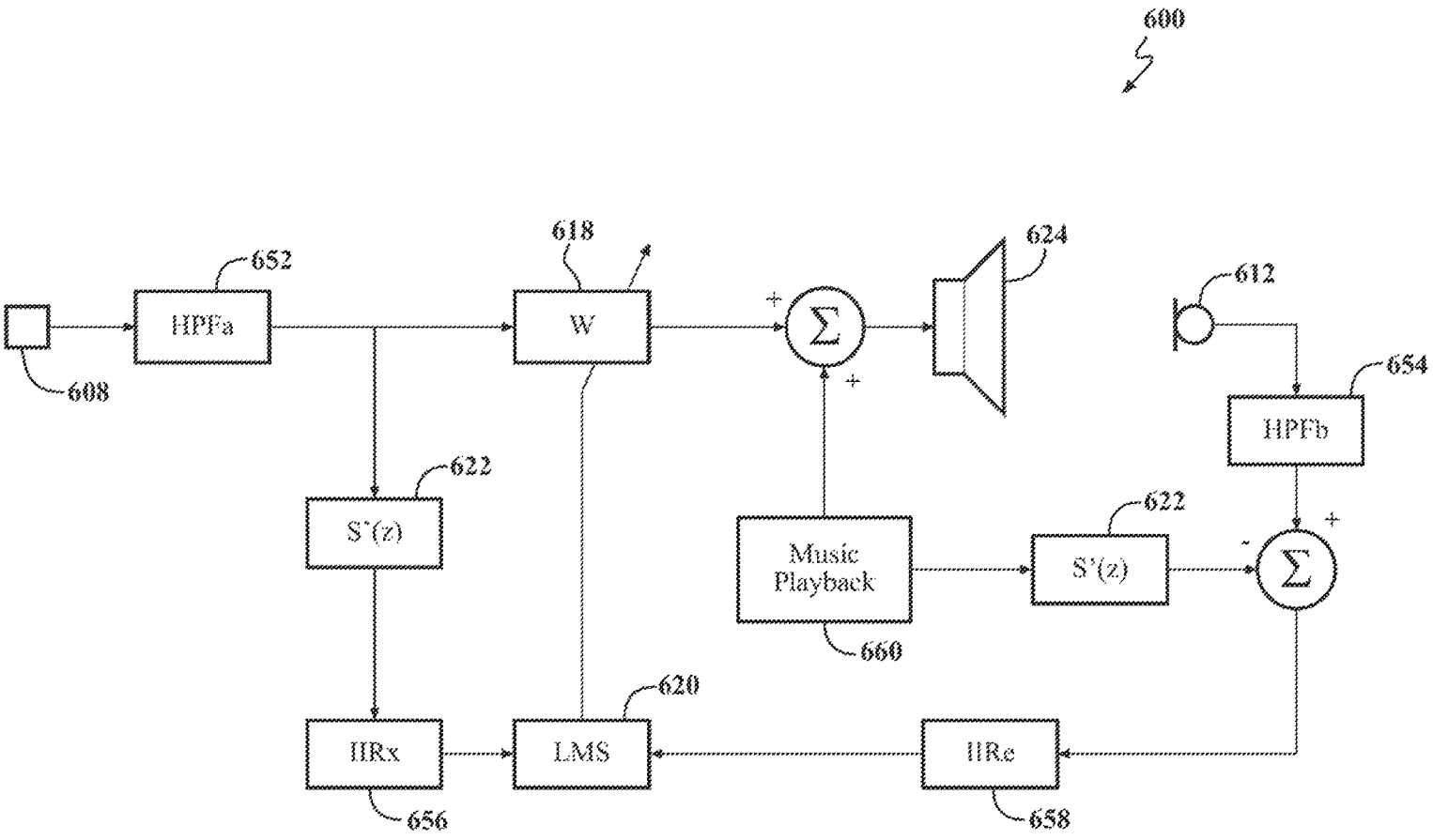
FIG. 6 is system diagram including an adaptive algorithm approach.

All of the parameters shown in FIG. 6 may be optimized for each road type. Specifically for each road type there is: 1) an optimal frequency dependent leakage, 2) IIRx and IIRe coefficients that provide either a flattened signal into the LM block and/or a peak over the frequency range for which one is interested in achieving the highest level of RNC, 3) optimal HPF corner frequency that reduces the lowest frequency components of the accelerometer and microphone signals, 4) optimal gain for each microphone, 5) optimal gain for each accelerometer, 6) optimal W filters from which to begin adaptation, 7) optimal frequency dependent step size, 8) optimal instability detector settings, and 9) etc.

Any of these parameters may be predetermined, as by engineers, according to a combination of vehicle type, tire type and road type and actual road tests or laboratory simulations. Additionally, or alternately, the parameters may be developed by on-board or cloud-based processors from one or multiple vehicles. Furthermore, the parameters, or any combination thereof, may be stored locally at a processor on the vehicle, or stored on the cloud and accessed by or downloaded to the vehicle.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

The invention claimed is:

1. A method for road noise cancellation on a vehicle having a road noise cancellation system, the method carried out on a device having a processing unit including a non-transitory computer-readable storage medium capable of executing instructions of a software program, the method comprising the steps of:

determining a set of road noise cancellation parameters for the road noise cancellation system, each set being associated with a vehicle type, a tire type, a road surface type, or a vehicle location;

programming a database that correlates data collected from one or more vehicles with the set of road noise cancellation parameters that optimize road noise cancellation system performance;

comparing data being collected from one or more vehicles with the set of road noise cancellation parameters in the database and a road noise cancellation system performance threshold value;

identifying the vehicle has traveled from a first road surface type to a second road surface type; and adjusting the set of road noise cancellation parameters that optimize the road noise cancellation system upon identifying the vehicle has traveled from a first road surface type to a second road surface type.

2. The method as claimed in claim 1, further comprising the steps of:

collecting data representative of road noise cancellation system performance;

transmitting collected data representative of noise cancellation system performance from one or more vehicles to a cloud-based processor;

comparing the road noise cancellation system performance using the cloud-based processor;

adaptively adjusting the set of road noise cancellation parameters based on the collected and compared road noise cancellation system performance; and re-programming the database with the adjusted set of road noise cancellation parameters.

3. The method as claimed in claim 2 further comprising the step of downloading the re-programmed database to the road noise cancellation system on the vehicle.

4. The method as claimed in claim 2 wherein the data being collected, transmitted, and compared in the cloud is identified from one or more road noise cancellation parameters selected from the group consisting of: W filters, accelerometer or microphone spectra, accelerometer or microphone time-dependent signals, acceleration characteristics, microphone-based acoustic performance data, road noise cancellation system performance data, vehicle make, vehicle model, tire type, and GPS location.

5. The method as claimed in claim 2 wherein the step of comparing the road noise cancellation system performance further comprises the steps of:

comparing a sound pressure level measured in the vehicle to a target sound pressure level specific to a vehicle type and a road surface type; and when the sound pressure level measured in the vehicle exceeds the target sound pressure level, applying adjustments to the set of road noise cancellation parameters that optimize the road noise cancellation system.

6. The method as claimed in claim 5 wherein the step of comparing the road noise cancellation system performance further comprises the steps of:

measuring a first sound pressure level in the vehicle with the road noise cancellation system active;

measuring a second sound pressure level in the vehicle with the road noise cancellation system inactive;

comparing a difference between the first and second measured sound pressure levels; and when the difference is less than a predetermined threshold value, applying adjustments to the set of road noise cancellation parameters that optimize the road noise cancellation system.

7. The method as claimed in claim 6 wherein the threshold value is a band averaged frequency value or a frequency by frequency target value of the sound pressure level.

8. The method as claimed in claim 2 wherein the step of comparing the road noise cancellation system performance further comprises the steps of:

comparing a signal representative of road noise cancellation system performance to a predetermined threshold value; and when the signal representative of road noise cancellation system performance is less than the predetermined threshold value, applying adjustments to the set of road noise cancellation parameters that optimize the road noise cancellation system.

9. The method as claimed in claim 8 further comprising the step of subtracting a music signal from the signal representative of road noise cancellation system performance.

10. A road noise cancellation system on a vehicle, the system comprising:

a set of road noise cancellation parameters for the road noise cancellation system, each set being associated with a vehicle type, a tire type, a road surface type, or a vehicle location;

a database that correlates data collected from one or more vehicles, one or more tire types, one or more road surface types, or one or more vehicle locations to the set of road noise cancellation parameters; and upon identifying the vehicle experiences a change from a first road surface type to a second road surface type, the correlated set of road noise cancellation parameters being communicated to the road noise cancellation system adjusting the set of road noise cancellation parameters that optimize the road noise cancellation system.

11. The system as claimed in claim 10 wherein the database further comprises data collected by a processor on the vehicle.

12. The system as claimed in claim 11 wherein the data collected by the processor on the vehicle is communicated to a cloud-based processor and the database is accessible in the cloud-based processor.

13. The system as claimed in claim 12 wherein the cloud-based processor correlates the database with data collected from a plurality of vehicles.

14. The system as claimed in claim 10 further comprising a performance threshold of the road noise cancellation system for detecting a change from a first road surface type to a second road surface type.

15. The system as claimed in claim 14 wherein the performance threshold further comprises a signal representative of road noise cancellation system performance.

16. A computer-readable medium comprising a program, which, when executed by one or more processors performs an operation comprising:

applying a set of road noise cancellation parameters for a road noise cancellation system in a vehicle traveling on a first road surface type, the set being associated with a vehicle type, a tire type, a road surface type, or a vehicle location;

collecting and comparing data with the set of road noise cancellation parameters in a database to identify when the vehicle has traveled from a first road surface type to a second road surface type; and upon identifying the vehicle has traveled from a first road surface type to a second road surface type, applying the set of road noise cancellation parameters in the database that optimize the road noise cancellation system for the second road surface type adjusting the set of road noise cancellation parameters that optimize the road noise cancellation system.

17. The computer-readable medium as claimed in claim 16 wherein the program further performs an operation comprising:

collecting data representative of road noise cancellation system performance;

transmitting collected data to a cloud-based processor;

comparing data collected and transmitted by a plurality of vehicles in the cloud-based processor;

adaptively adjusting the set of road noise cancellation parameters based on the collected and compared data; and communicating the adjusted set of road noise cancellation parameters to the road noise cancellation system.

18. The computer-readable medium as claimed in claim 17 wherein data representative of road noise cancellation system performance further comprises a sound pressure level measured in the vehicle as compared to a target sound pressure level specific to a vehicle type, a tire type or a road surface type.

19. The computer-readable medium as claimed in claim 16 wherein the set of road noise cancellation parameters further comprises road noise cancellation parameters selected from the group consisting of: W filters, accelerometer or microphone spectra, accelerometer or microphone time-dependent signals, acceleration characteristics, microphone-based acoustic performance data, road noise cancellation system performance related data, vehicle make, vehicle model, tire type, and GPS location.

20. The computer-readable medium as claimed in claim 16 wherein collecting and comparing data with the set of road noise cancellation parameters in the database further comprises:

collecting data from a plurality of vehicles;

transmitting the collected data to a cloud-based processor; and comparing transmitted collected data from a plurality of vehicles in the cloud-based processor to identify when a vehicle has traveled from a first road surface type to a second road surface type.

* * * * *